US005289701A

United States Patent [19]

Mitsumoto et al.

[11] Patent Number: 5,289,701

[45] Date of Patent: Mar. 1, 1994

[54] METHOD OF DETERMINING SLEEVE AND BODY PATTERNS

[75] Inventors: Shigenobu Mitsumoto; Masao Okuno, both of Wakayama, Japan

[73] Assignee: Shima Seiki Mfg., Ltd., Wakayama, Japan

[21] Appl. No.: 932,152

[22] Filed: Aug. 19, 1992

[30] Foreign Application Priority Data

Aug. 19, 1991 [JP] Japan ..... 3-206878

[51] Int. Cl.[5] ..... D04B 7/24; A41B 9/06

[52] U.S. Cl. ..... 66/76; 66/176

[58] Field of Search ..... 66/76, 171, 176

[56] References Cited

U.S. PATENT DOCUMENTS 3,035,426 5/1962 MacQueen ..... 66/76
3,695,063 10/1972 Betts et al. ..... 66/176
3,824,810 7/1974 Betts et al. ..... 66/76
3,990,271 11/1976 Jeffcoat ..... 66/176
4,192,157 3/1980 Hida et al. ..... 66/76
4,197,724 4/1980 Robinson et al. ..... 66/176
4,398,402 8/1983 Robinson et al. ..... 66/176

FOREIGN PATENT DOCUMENTS 2166569 9/1974 Fed. Rep. of Germany ..... 66/76

*Primary Examiner*—Clifford D. Crowder
*Assistant Examiner*—John J. Calvert
*Attorney, Agent, or Firm*—Edwin E. Greigg; Ronald E. Greigg

[57] ABSTRACT

A method for determining a sleeve and body pattern so that each sleeve is the same vertically as related to the body. The body is arranged so that the vertical height of an armhole between a shoulder point and an underarm point is equal in height of a set-in region of the sleeve pattern. The sleeves are joined to the body of the garment by a knitting process.

2 Claims, 9 Drawing Sheets

METHOD OF DETERMINING SLEEVE AND BODY PATTERNS

BACKGROUND OF THE INVENTION

The present invention relates to a method of determining patterns or shapes of knitted segments for efficiency knitting a knit product, e.g. a sweater or cardigan, which is also known as an integral or whole garment, with the use of a knitting machine which performs a knitting action for yielding rows of major stitches, and more particularly, a method of determining a sleeve and a body pattern which are joined in a good fit.

In common, a body portion and a sleeve or other portion of a knit fabric are joined by sewing at the joining step succeeding the knitting step. This takes a considerable length of time in the production. Also, a resulting knitted product composed of the segment portions joined by sewing will exhibit less stretchability and if worse, may be torn apart along a joined seam in use.

For overcoming the foregoing drawback, modified methods have been introduced which incorporate an integral or whole garment knitting technique. One such method is proposed by the same applicant as of this specification, as disclosed in Japanese Patent Laid-open Publication 2-229248(1990), in which each tubular sleeve portion is joined with a body portion during knitting action with the use of a flat knitting machine which has two pair of front and rear needle beds arranged in an upper position and a lower position respectively. front and rear sides respectively.

Since the set-in end of each sleeve portion is joined to the armhole of the body portion, the two seams have to be equal to each other in the number of stitches. The disadvantage of the method is that the two seams can be joined with difficulty while their armhole circumferential lengths only are measured to match. In action, optimum patterns or shapes of the sleeve and body portions for desired joining will be given through a series of experiments, which will result in the loss of time.

Hence, the method of knitting sleeve and body patterns of which shapes are determined after a number of trials is low in the productive efficiency and when modification is wanted in the shape, it has to use a troublesome cut-and-try technique.

In particular, if such sleeve and body patterns are joined while their length measurements are translated to stitches, it will be necessary, due to difference in the number of courses, to displace some stitches and/or adjust the number of lines. Therefore, an improved method of determining patterns for optimum joining has been wanted.

OBJECT AND SUMMARY OF THE INVENTION

It is an object of the present invention to provide an improved method in which both a sleeve and a body pattern are simultaneously determined from the standard ratio between vertical and horizontal stitches so that assignment of stitches to the patterns can easily be implemented without any troublesome control.

According to the present invention, a method of determining a sleeve and a body pattern of a knit product which are joined to each other during a knitting operation with a knitting machine, comprises the step of having the body pattern arranged so that the vertical length or height of an armhole thereof between a shoulder point and an underarm point is equal to the height of a set-in triangle region of the sleeve pattern.

Also, for modification of the sleeve pattern or size, the set-in region of the sleeve pattern can be shaped into a trapezoid form which is smaller by a given distance in the height than the original triangle form.

In action, the pattern determining method of the present invention allows the sleeve and body patterns to be created so that the vertical length or height of the armhole of the body pattern between the shoulder end and the underarm end is equal to the height of the set-in region of the sleeve pattern. Accordingly, the sleeve pattern is neatly joined to the body pattern and is equal to it in the number of course stitches.

The set-in region of the sleeve pattern can be shifted from the original triangle shape to a trapezoid shape for decreasing its height by any desired distance. In this case, the knitting is carried out by joining the wale stitches of the top side of the trapezoid shape of the sleeve pattern to the course stitches of the desired distance from the shoulder end of the armhole of the body pattern at a predetermined stitch ratio. Any desired shape of the set-in region of the sleeve pattern can be fabricated according to the method of the present invention.

DETAILED DESCRIPTION OF A PREFERRED EMBODIMENT

A method of determining patterns according to the present invention will be described referring to the accompanying drawings.

Figure 1:
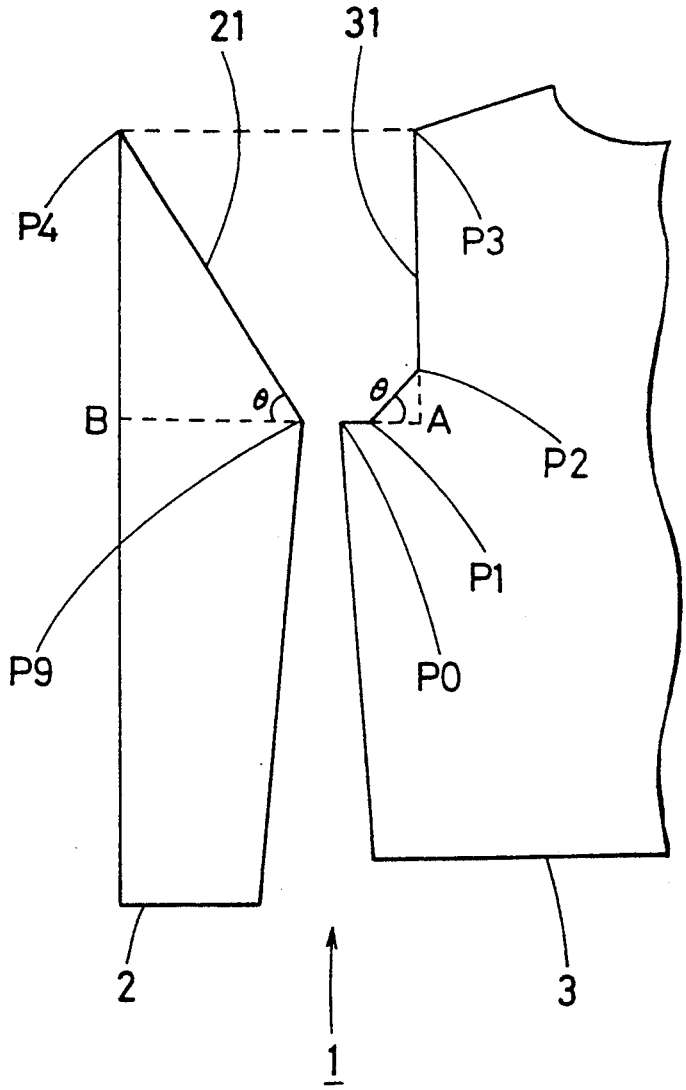
FIGS. 1 to 3 are explanatory views showing patterns which are fabricated by a method of the present invention.
Figure 2:
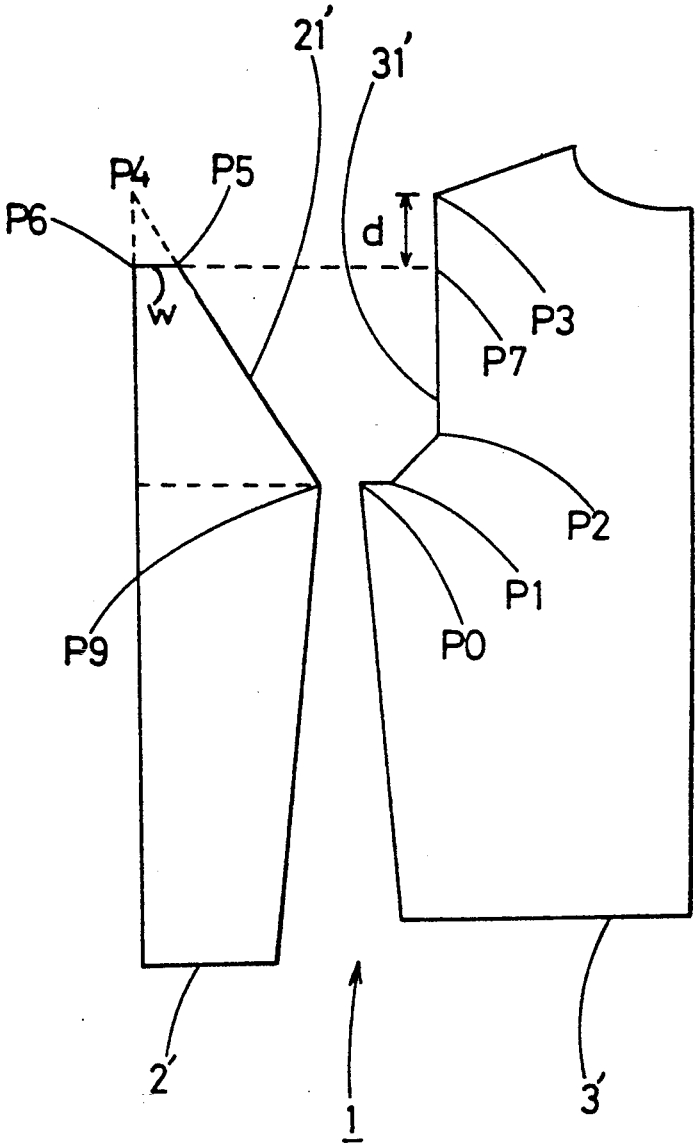

FIGS. 1 and 2 show the right half of a set-in-sleeve sweater of which segment patterns are determined by the method of the present invention, while the left half is not illustrated for ease of explanation.

As shown in FIG. 1, a sweater 1 is composed of a sleeve pattern 2 and a body pattern 3.

The width of the sleeve pattern 2 is measured from a reference point P9 at the underarm to a point B on the horizontal line extending from the point P9. The distance from the point B to its overhead point P4 is designated to match a sleeve set-in measurement. The extension of an armhole end 21 of the sleeve 2 is measured between the points P4 and P9. It is also assumed that the line between P4 and P9 is at an angle $\theta$ to the horizontal line between B and P9.

The body pattern 3 has a reference point P0 located at the underarm and a first point Pl distanced by the length of a gusset horizontally from the reference point P0. A second point P2 is located at the intersection of the vertical shoulder-end line with the line which extends from the point P1 at the angle $\theta$ to the horizontal line between P0 and P1. A third point P3 at the shoulder is distanced from the horizontal or reference P0 line upwardly by a length equal to the sleeve set-in measurement. Hence, an armhole end 31 of the body pattern 3 is extended from P0 to P1, P2 and P3. The point A is located at the intersection between the horizontal line from the reference point P0 and the perpendicular line fron the third or shoulder point P3.

The sleeve patterns 2 and 3 are symmetrically shown in the left half of the set-in sleeve sweater.

The size of an armhole determined by the armhole end 31 of the body pattern 3 is designated by a diagonal line which extends between P0 and P3. The length of the sleeve pattern 2 and other measurements are not specified as will be determined by individual requirements. When the number of stitches in a given wale length is x, and the number of stitches in a given course length is y in the patterns 2 and 3, a ratio between the distances, where the decrease of stitches, e.g. one wale in every two courses, is given at either sleeve set-in and body underarm, is expressed by:

$$P1A:P2A = P0B:P4B = \frac{1}{x} : \frac{2}{y}$$

Hence, $$\frac{P2A}{P1A} = \frac{P4B}{P0B} = \frac{2x}{y}$$

Then, the angle $\theta = \tan^{-1}(2x/y)$.

It should be understood that the decrease is not limited to one wale in every two courses.

Figure 6:
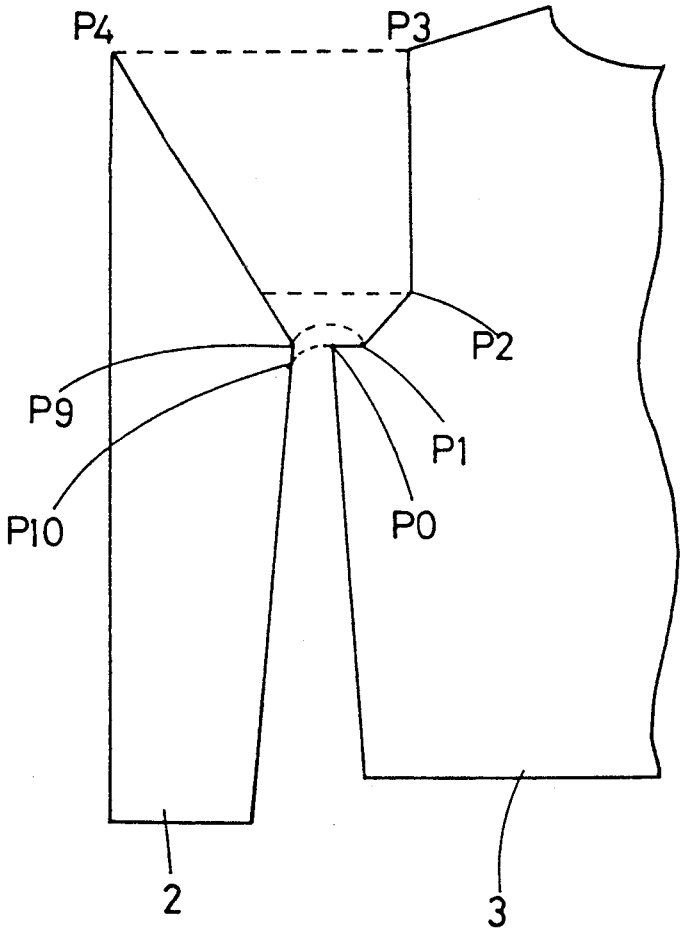
FIGS. 6 to 9 are explanatory views showing stitch-to-stitch movements in joining the sleeve pattern to the body pattern.

For fabricating the sweater, each sleeve pattern is joined to the body pattern so that a point P10 beneath the reference point P9 of the sleeve pattern meets the reference point P0 of the body pattern, the point P9 of the sleeve pattern meets the point P1 of the body pattern, and the point P4 of the sleeve pattern meets the point P3 of the body pattern, as best shown in FIG. 6.

A technique for modifying the standard shape of a set-in region of the sleeve pattern will now be explained.

Shown in FIG.2 are a sleeve pattern 2' and a body pattern 3' similar to those illustrated in FIG.1.

The sleeve pattern 2' has an armhole end 21' which is defined by the line between the reference point P9 and the uppermost point P4 as similar to that explained in FIG.1.

Also, the body pattern 3' has an armhole end 31' determined by the line which extends from the reference point P0 to the points P1, P2, and P3 as is similar to that explained in FIG.1.

For decreasing the set-in region of the sleeve pattern 2', a portion cut along the horizontal line which extends between two points P5 and P6 and is spaced a distance d from the uppermost point P4 is terminated.

The corresponding point of the body pattern 3' is denoted by P7 as downwardly spaced d from the shoulder point P3.

Figure 4:
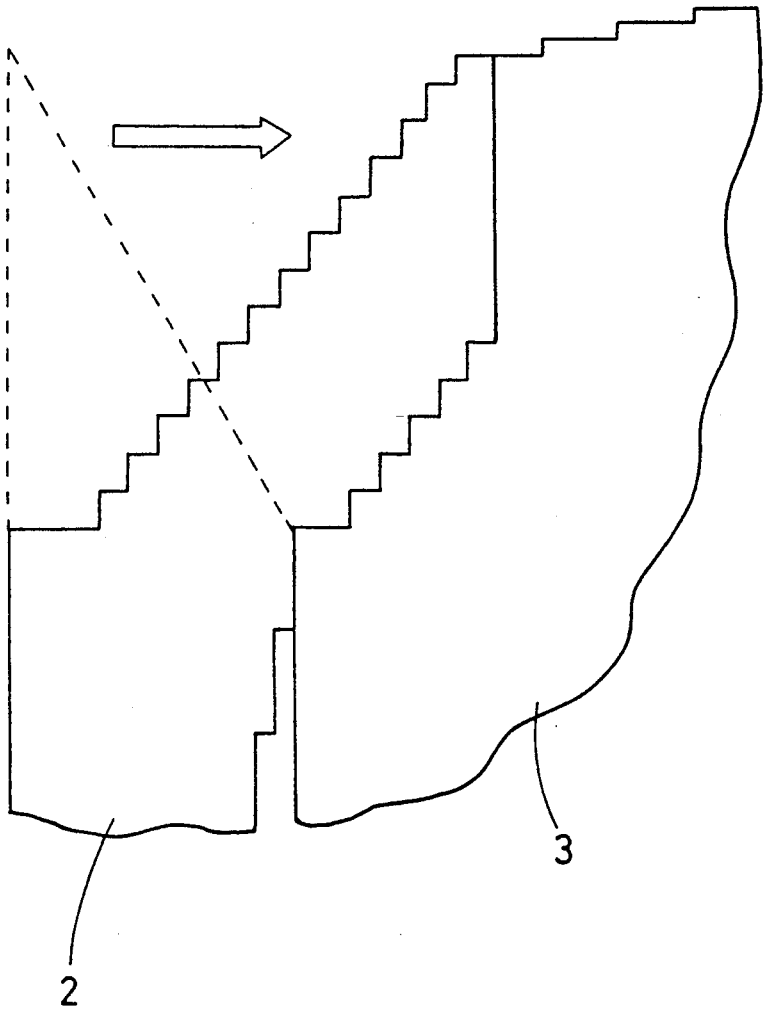
FIGS. 4 and 5 are explanatory views of a sleeve pattern joined to a body pattern.
Figure 5:
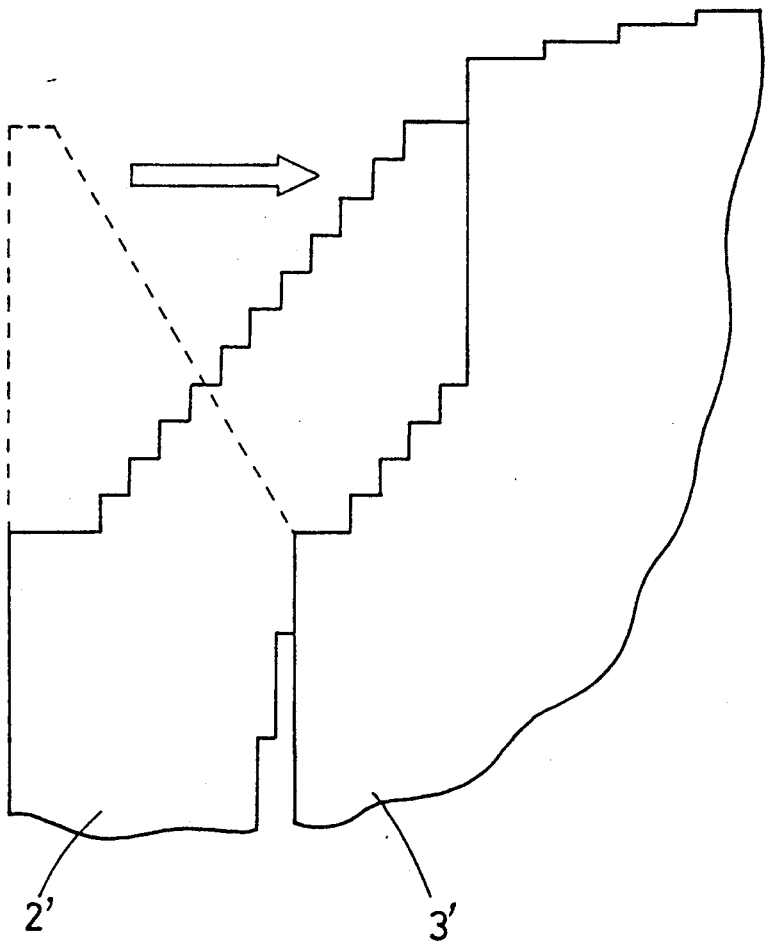

In both cases shown in FIGS.1 and 2, each sleeve pattern is joined to the body pattern through laterally displacing its armhole end stitches wale by wale towards the body pattern as shown in FIGS.4 and 5 respectively.

Figure 7:
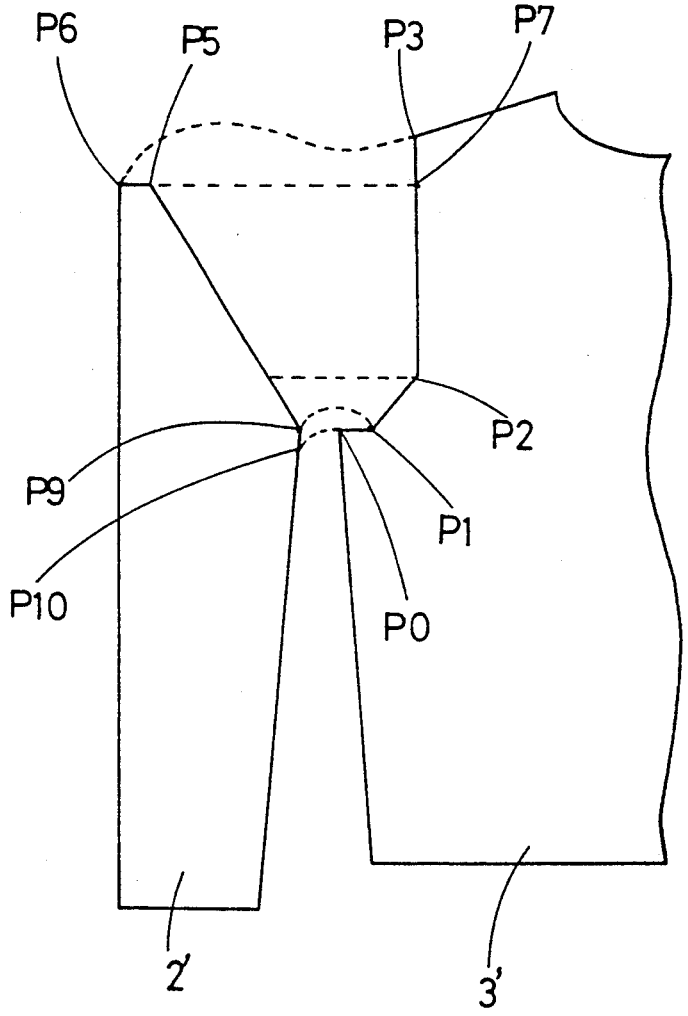

More particularly, the points P5, P9, and P10 of the modified sleeve pattern 2' are coincided to the points P7, P1, and P0 of the body pattern 3' respectively and the loops of yarn from P5 to P6 are placed over a row of loops from P7 to P3 in every wale as shown in FIG. 7.

If the ratio of courses between P7 and P3 to wales between P5 and P6 is not 2:1, either has an excessive number of the stitches.

Figure 8:
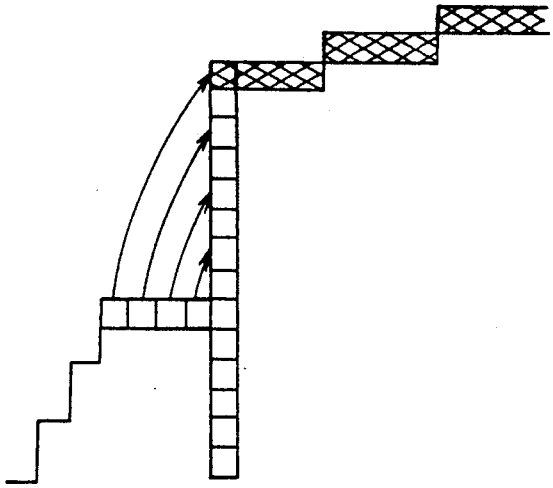
Figure 9:
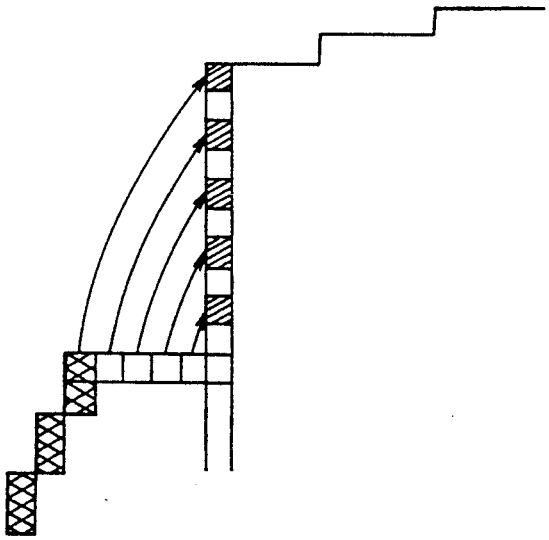
Figure 10:
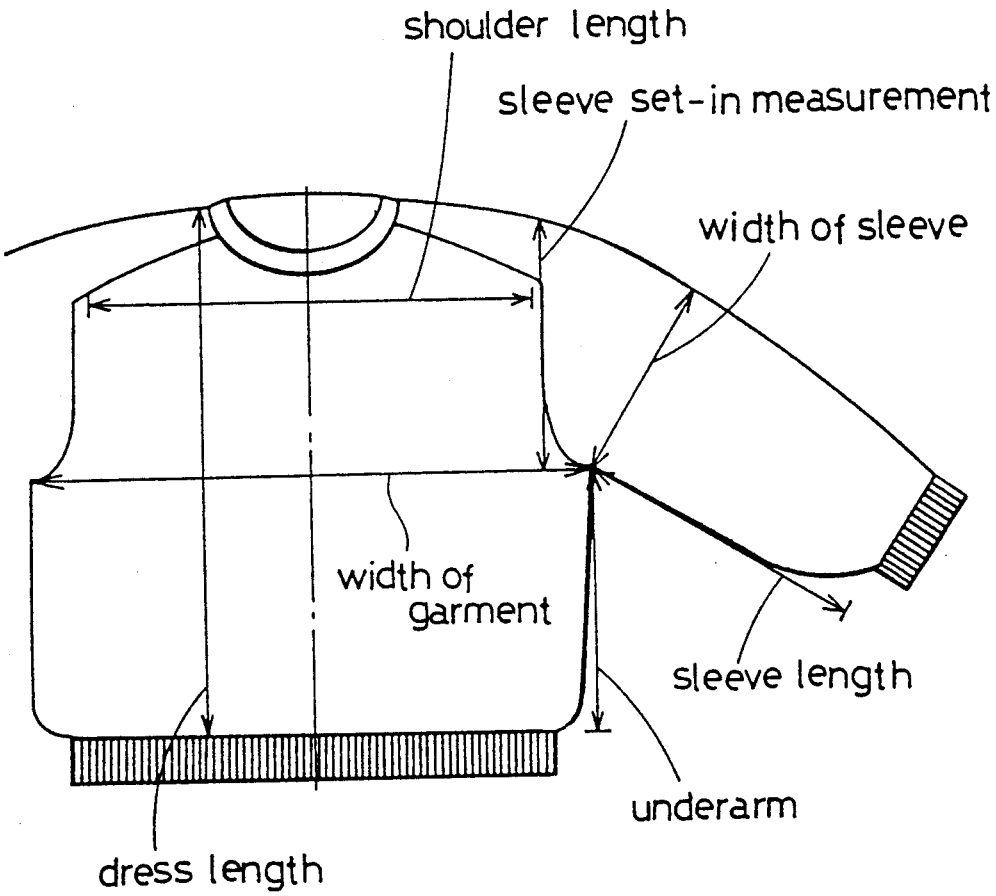
FIG. 10 is a front view of a sweater knitted according to the present invention.

The excess of the stitches can be offset by adding a series of stitches to the body pattern as denoted by the cross hatching in FIG.8 or by adding a series of stitches to the sleeve pattern as denoted by the cross hatching in FIG.9.

It is now assumed that the distance between P5 and P6 is w. As a triangle determined by the three points P4, B, and P0 is similar to a triangle determined by the points P4, P6, and P5, the equation is established as:

$$\frac{d}{w} = \frac{2x}{y}$$

Then, $$d = \frac{2xw}{y}$$

When the point P5 is located at any point on the oblique line between P9 and P4, the stitch number of d can be two times greater than w with x and y being predetermined.

Also, it is a good idea that the ratios of wale and course stitches to their respective given lengths in which corresponding sleeve and body patterns are knitted and joined with a level of success are assigned as default values. Accordingly, when the number of stitches per given length is undetermined, each pattern can be designed to an appropriate shape.

Figure 3:
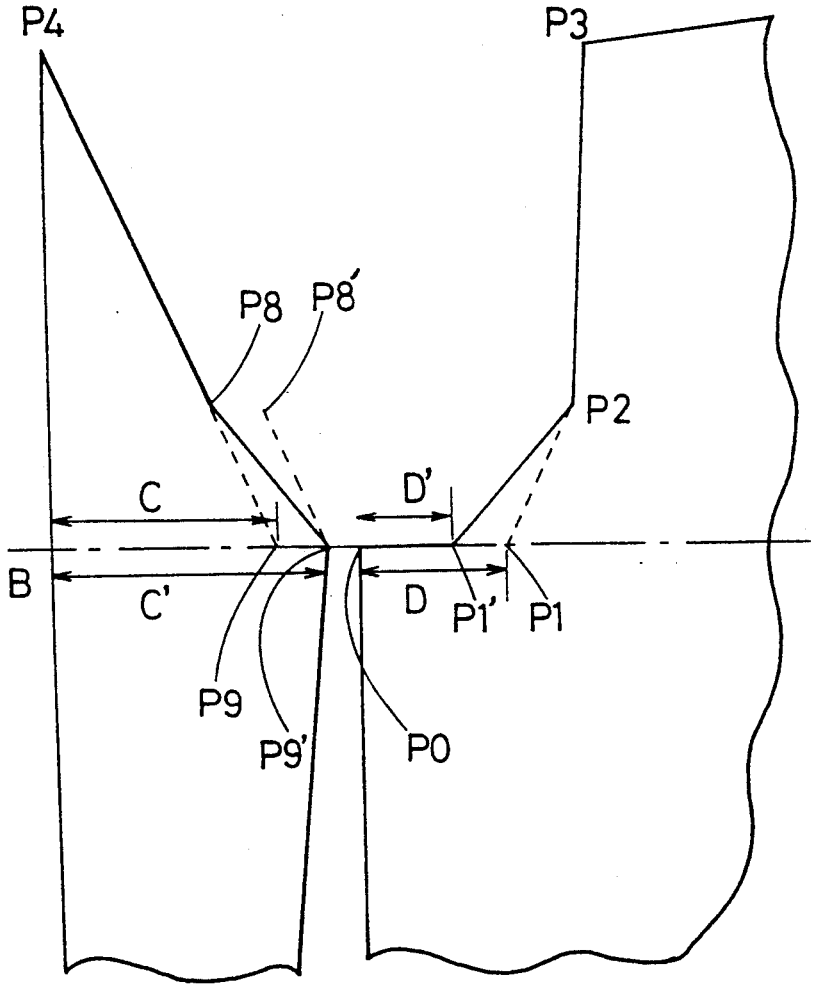

For increasing the width of a sleeve pattern, a gusset of the body pattern is shortened to decrease a greater number of stitches at the underarm, as shown in FIG.3, so that the rate of stitch decreasing in the sleeve can be maintained uniform. For example, when the width of an original sleeve pattern is C and the length of an original gusset of a body pattern is D, the displacement from P1 to P1' corresponding to a difference (C'-C) between the original width C and its increased width C' results in decrease of the gusset length to D'.

As the result, the angle P1P1'P2 becomes smaller and thus, a greater number of the stitches than that in the original pattern are to be decreased.

Even if the decrease of stitches in the original sleeve pattern is carried out from P9' to P8', the result is equivalent to the stitch decrease along the diagonal line P9'P8 of a parallelogram determined by the four points P9, P9', P8', P8. Hence, the rate of decreasing will be maintained uniform in the sleeve pattern.

The measurements of a pattern are determined corresponding to the ratio between the vertical and horizontal stitches which is predetermined for the standard shape.

As set forth above, a pattern of a desired shape can be fabricated, regardless of counting the number of stitches in a given length, by the method of the present invention in which the measurements of the pattern are determined corresponding to the ratio between vertical and horizontal stitches which is preset for the standard pattern.

Accordingly, the method of the present invention allows a pattern to be determined at high efficiency for a knitting operation.

Also, the method can control a knitting machine without use of any templates.

What is claimed is:

1. A method for determining a pattern for a sleeve and body of a knit product in which the sleeve and body are joined together during a knitting operation of a knitting machine, comprising:

determining a first reference point (P0) at an underarm connection of said body, extending a horizontal line through said reference point perpendicular to a vertical center line of said body, determining an underarm point (P9) of said sleeve on said horizontal line spaced from said reference point (P0) a distance away from said reference point (P0) and said body, determining the number of knitting stitches along said horizontal line from reference point (P9) to reference point (B) required for a width (P9-B) of said sleeve, determining a sleeve set-in distance (B-P4) on a first vertical line from reference point (B) to reference point (P4) and determining the number of courses along said first vertical line from reference point (B) to reference point (P4), determining an extension of said armhole of the sleeve by measuring a distance between the sleeve set-in reference point (P4) and the underarm reference point (P9) to determine a number of stitches to be dropped as the courses are knitted between reference point (B) and reference point (P4) and to determine an angle $\theta$ formed by said horizontal line and a line form reference point (P4) through the underarm reference point (P9), to form a sleeve armhole end (21), determining a matching sleeve pattern on said knit body related to said first reference point (P0), determining a length of a gusset along said horizontal line from said first reference point (P0) to a reference point (P1) to determine a shoulder-end line by extending a second vertical line from reference point (P3) corresponding to a sleeve set-in measurement, extending a line from point (P1) to said second vertical line at point (P3) and determining an angle $\theta$ with said horizontal line by extending a line from point (P1) to intersect line (P3-A) at (P2) to establish a point (P2), thereby forming an armhole end (31) of said body portion which extends from reference point (P3) to reference point (P2), from reference point (P2) to reference point (P1) and from reference point (P1) to reference point (P0) whereby the sleeve pattern and the body pattern have the same height and same number of courses.

2. A method for determining a body and sleeve pattern of a knit product including measuring distances on both the body and the sleeve portion, setting a reference point as a standard measurement, a step of establishing pattern coordinates for the knit garment, and determining a height of an armhole of a body pattern so that the height would be equal to a height of a set-in triangular region of the sleeve.

* * * * *